US006953095B2

(12) United States Patent
Randa

(10) Patent No.: US 6,953,095 B2
(45) Date of Patent: Oct. 11, 2005

(54) METHOD AND SYSTEM FOR OPERATING A REVERSIBLE PNEUMATIC GROUND PIERCING TOOL

(75) Inventor: Mark D. Randa, Summit, WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 11/031,923

(22) Filed: Jan. 7, 2005

(65) Prior Publication Data

US 2005/0150670 A1 Jul. 14, 2005

Related U.S. Application Data

(60) Provisional application No. 60/535,617, filed on Jan. 9, 2004.

(51) Int. Cl.[7] ..... E21B 4/14
(52) U.S. Cl. ..... 173/1; 173/91
(58) Field of Search ..... 173/1, 90, 91, 173/11, 19; 175/19, 296

(56) References Cited

U.S. PATENT DOCUMENTS 3,952,813 A * 4/1976 Chepurnoi et al. ..... 173/91
4,214,638 A * 7/1980 Sudnishnikov et al. ..... 173/1
4,662,457 A 5/1987 Bouplon ..... 173/91
5,086,848 A * 2/1992 Hudak ..... 173/1
5,172,771 A 12/1992 Wilson ..... 173/1
5,327,636 A * 7/1994 Wilson ..... 29/525
5,467,831 A * 11/1995 Spektor ..... 175/19
5,505,270 A 4/1996 Wentworth ..... 173/1
5,603,383 A * 2/1997 Wentworth et al. ..... 173/91
5,803,182 A * 9/1998 Bakke ..... 173/91
6,269,889 B1 * 8/2001 Wentworth ..... 173/91
6,371,220 B1 * 4/2002 Hesse et al. ..... 175/19
6,467,554 B1 10/2002 Millican ..... 173/91
6,644,417 B1 * 11/2003 Millican ..... 173/1

* cited by examiner

*Primary Examiner*—Scott A. Smith
(74) *Attorney, Agent, or Firm*—Philip G. Meyers

(57) ABSTRACT

A method of the invention uses a pneumatic ground piercing tool having a reversing mechanism with a supplemental air line capable of supplying compressed air for reverse operation to a radial port in the air distributing mechanism. This radial port is located between a pair of bearing surfaces on the step of the air inlet conduit, and when pressurized by the supplemental air line, causes the front pressure chamber to receive compressed air earlier than normal, shifting the stroke of the striker rearwardly so that the tool operates in reverse. Such a method includes the steps of operating the tool in forward mode by supplying compressed air to the first air hose, and operating the tool in reverse mode by supplying compressed air to the second air hose while permitting partial venting of the front pressure chamber through the first air hose.

5 Claims, 5 Drawing Sheets

METHOD AND SYSTEM FOR OPERATING A REVERSIBLE PNEUMATIC GROUND PIERCING TOOL

This application claims priority of U.S. Provisional Application No. 60/535,617, filed Jan. 9, 2004.

BACKGROUND OF THE INVENTION

This invention relates to methods of operating pneumatic impact tools, particularly to self-propelled ground piercing tools. Wentworth U.S. Pat. No. 5,505,270, Apr. 9, 1996, the entire contents of which are incorporated by reference herein for all purposes, describes a reversible pneumatic ground piercing tool having a reversing mechanism with a supplemental air line capable of supplying compressed air for reverse operation to a radial port in the air distributing mechanism. This radial port is located between a pair of bearing surfaces on the step of the air inlet conduit, and when pressurized by the supplemental air line, causes the front pressure chamber to receive compressed air earlier than normal, shifting the stroke of the striker rearwardly so that the tool operates in reverse. Opening the supplemental air line to the atmosphere produces a short stroke forward mode of operation useful for operations wherein a less forceful impact is desirable.

Experience with the tool of the '270 patent revealed areas for possible improvement. The short stroke forward mode finds little practical application, and thus it is not essential to provide for it. The reverse impact of the '270 tool is relatively weak and not sufficient for use in vertical applications such as pile driving. Problems were also encountered with double-hitting, where the striker during reverse mode hits against both the front and rear anvil surfaces rather than stopping short of the anvil or front impact surface. The present invention addresses these difficulties.

SUMMARY OF THE INVENTION

The invention provides a method and apparatus for operating reversible pneumatic ground piercing tool. Such a tool includes an elongated tool body having a rear opening and a front nose including an anvil. A striker is disposed for reciprocation within an internal chamber of the housing to impart impacts to a rear impact surface of the anvil for driving the tool forwardly through the ground. The striker has a rear bearing in sealed, sliding engagement with an inner wall of the tool body. An air distributing mechanism effects reciprocation of the striker. Such a mechanism includes a rearwardly-opening recess in the striker having a radial air flow port extending through a wall of the recess, a stepped air inlet slidably disposed in the recess in sealed engagement with the recess wall, the stepped air inlet having a front external edge, a rear external edge, a first air flow passage extending through the air inlet from rear to front in a lengthwise direction, and a first air hose connected to the first air flow passage for supplying compressed air to the recess to push the striker forwardly until the radial port in the recess wall passes the front edge of the stepped air inlet, at which time compressed air enters a front pressure chamber ahead of the rear seal bearing of the striker thereby beginning a rearward stroke of the striker, travel of the striker continuing rearwardly until the radial port in the recess wall passes over the rear edge of the stepped air inlet, thereby depressurizing the front pressure chamber.

A tail assembly is mounted in a rear end opening of the housing to secure the striker and air distributing mechanism in the housing and receive rearward impacts from the striker when the tool is operating in reverse. The tool also has a reversing mechanism including a second air flow passage extending from the rear of the stepped air inlet to a radial port on an exterior surface of the stepped air inlet between the front and rear external edges thereof, and a second air hose connected to the second air flow passage for supplying compressed air to the radial port in the stepped air inlet to pressurize the front pressure chamber when the radial port in the recess wall moves over the radial port in the stepped air inlet, thereby beginning a rearward striker stroke sooner than if no compressed air is supplied to the radial port of the stepped air inlet.

A method of the invention using such a tool includes the steps of operating the tool in forward mode by supplying compressed air to the first air hose, and operating the tool in reverse mode by supplying compressed air to the second air hose while permitting partial venting of the front pressure chamber through the first air hose. These and other aspects of the invention are discussed further in the detailed description that follows.

BRIEF DESCRIPTION OF THE DRAWING

In the accompanying drawing, wherein like numerals denote like elements.

DETAILED DESCRIPTION

Figure 1:
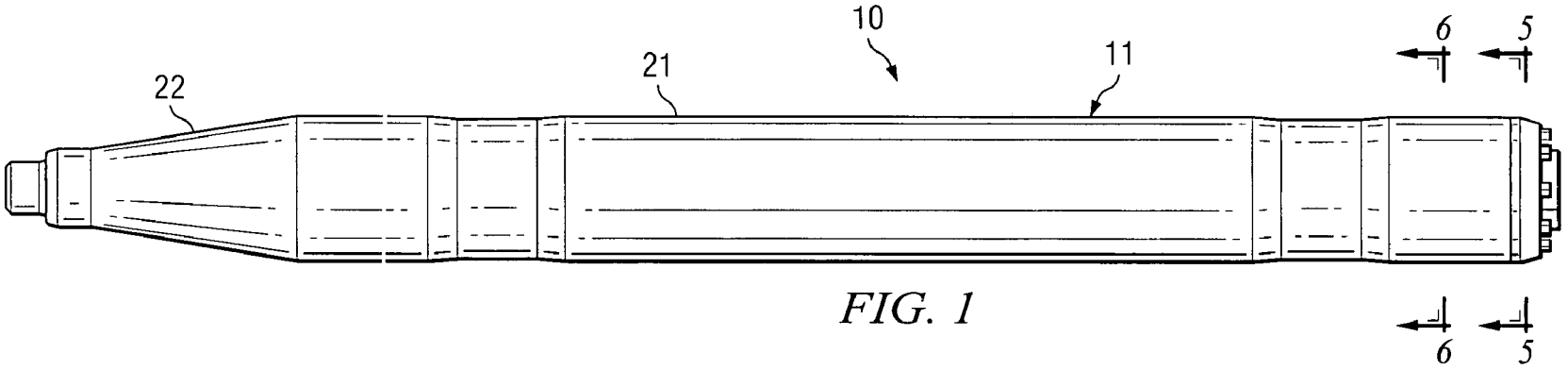
FIG. 1 is a side view of a pneumatic piercing tool according to the invention.
Figure 2:
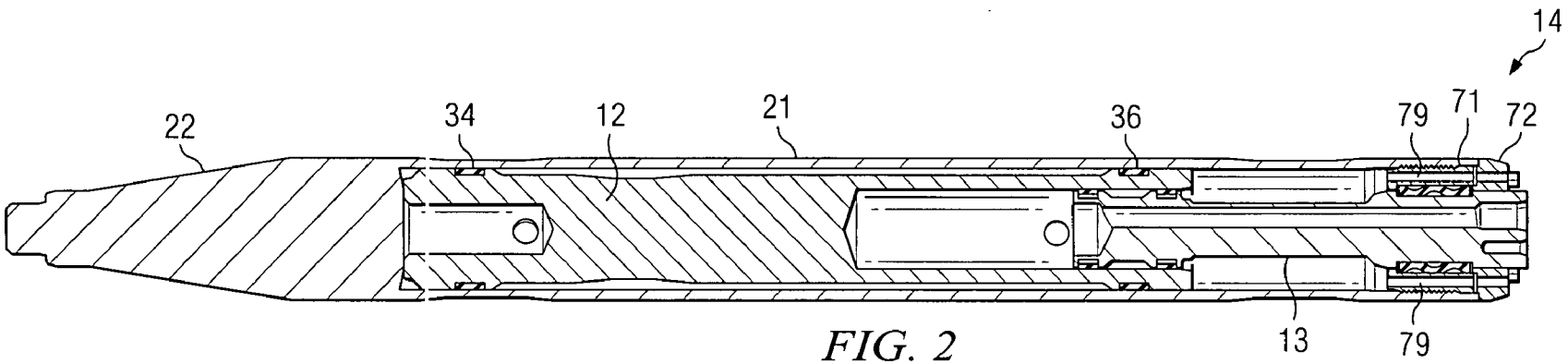
FIG. 2 is a lengthwise sectional view of the tool of FIG. 1 taken along the line 2—2 in FIG. 7.
Figure 3:
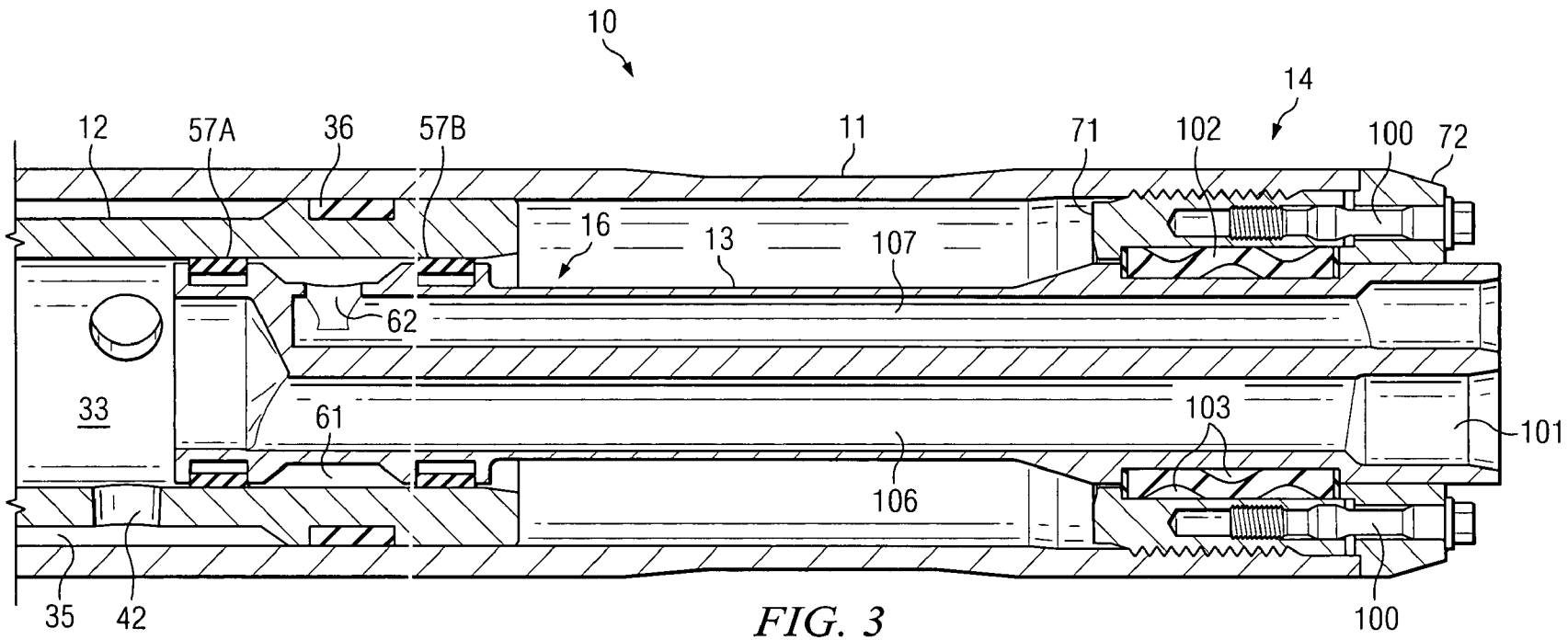
FIG. 3 is a partial, enlarged lengthwise sectional view taken at an angle showing the two compressed air flow passages through the stepped air inlet.
Figure 4:
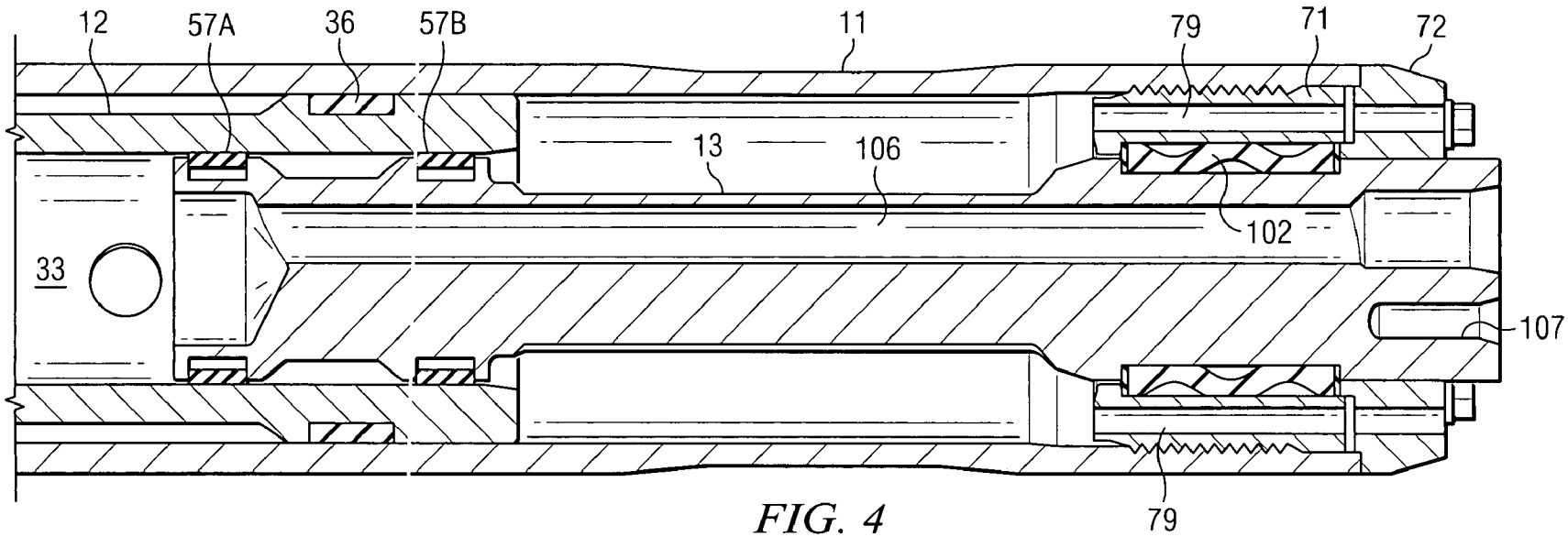
FIG. 4 is a partial, enlarged lengthwise sectional view of the rear end of the tool shown in FIG. 2.
Figure 5:
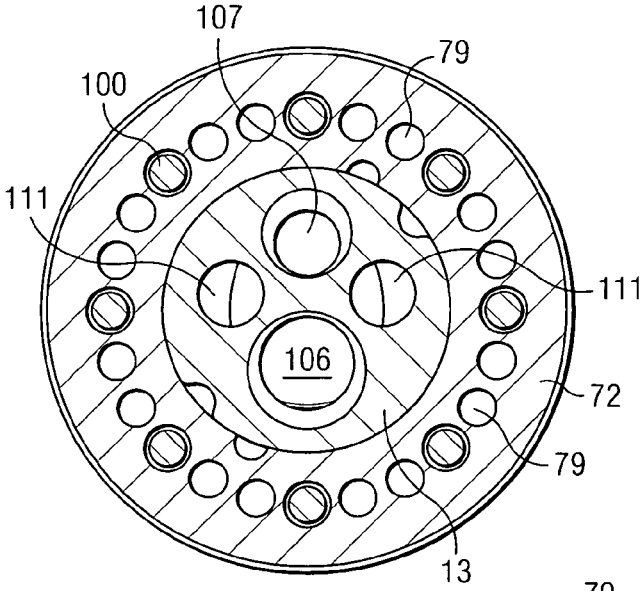
FIG. 5 is a cross sectional view taken along the line 5—5 in FIG. 1.
Figure 6:
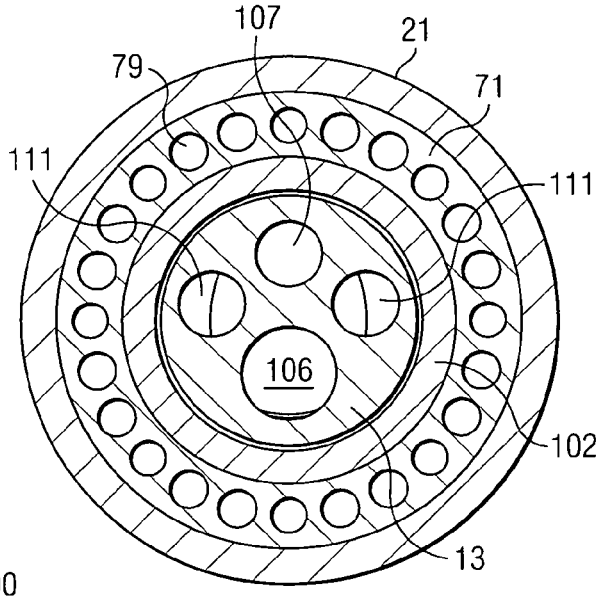
FIG. 6 is a cross sectional view taken along the line 6—6 in FIG. 1.
Figure 7:
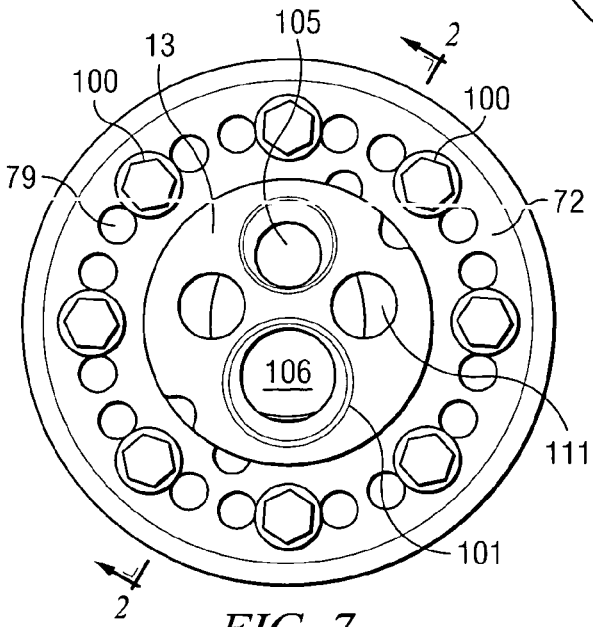
FIG. 7 is a rear view of the tool shown in FIG. 1 (hoses omitted)

The structure of the ground piercing tool used in the invention may be identical to that described in U.S. Pat. No. 5,505,270. However, certain changes in the structure of the tool have been made to enhance performance and simplify manufacture and are briefly discussed herein. Referring to FIGS. 1–7, a pneumatic ground piercing tool 10 according to the invention includes a tool body 11 which includes a tubular housing 21 and a unitary nose 22 providing the anvil (inner front impact surface) for a striker 12. Pairs of plastic, front and rear seal bearing rings 34, 36 are disposed in corresponding annular grooves in the outer periphery of striker 12 for movement along the inner surface of housing 21. A stepped air inlet conduit 13 cooperates with striker 12 for forming an air distributing mechanism to supply compressed air to reciprocate striker 12. A tail assembly 14 which allows exhaust air to escape from the tool and secures conduit 13 to body 11. A plurality of rear radial ports 42 in striker 12 allow communication between a rearwardly opening recess 33 in striker 12 and a front pressure chamber 35 between striker 12 and housing 21 in front of seal bearing 36.

Stepped air inlet conduit 13 is a machined metal part that extends back and through tail assembly 14. Tail assembly 14 according to the invention includes a tail nut 71 threadedly coupled to the interior of tool body 11 near the rear end opening thereof. A disk-shaped end cap 72 is secured to tail nut 71 in engagement with the rear end of tool body 11 by means of a series of tail bolts 100 which apply an axial clamp load to nut 71 as described in Wentworth U.S. Pat. No. 5,025,868, the entire contents of which are incorporated by reference herein. Exhaust passages 79 extend through nut 71 at locations offset from tail bolts 100. A pair of additional, inner exhaust passages 111 are provided through air inlet 13 at locations offset from passages 106, 107 discussed below. A first compressed air hose 53A, which may be made of rubberized fabric, is secured by a threaded nozzle into a threaded socket 101 that opens at the rear end of air inlet 13. Air inlet 13 further has an annular groove therein in which a shock absorber 102 made of ether-based polyurethane Shore A 90 durometer, is secured in the space between tail nut 71 and air inlet 13. Shock absorber 102 may be made of conventional elastomeric rubber or plastic, but has a series of alternating, inner and outer, rounded undercuts 103 that give shock absorber 102 a wavy profile in cross section, i.e., an accordion-shape as shown. It has been found that removal of material in this manner, departing from the cylindrical shape used the in the prior art, gives a stiff (high durometer) shock absorber more compressibility and improves performance and durability.

The stepped cylindrical outer surface of inlet 13 is inserted into recess 33 in slidable, sealing engagement with the wall thereof. Recess 33 and the adjoining interior space of stepped conduit 13 together comprise a rear pressure chamber which communicates intermittently with the front pressure chamber 35 by means of holes 42. Air inlet 13 has front and rear plastic bearing rings 57A, 57B disposed in annular peripheral grooves to reduce air leakage between inlet 13 and the cylindrical wall of recess 33.

Hose 53A provides pressurized air to recess 33 for operating the tool in forward mode. Air passes from hose 53A through a lengthwise passage 106 in air inlet 13 which widens at its rear end and forms part of rear pressure chamber 33. In this embodiment, only one hose is used to supply compressed air for forward travel, as compared to two in the '270 patent. A reversing mechanism 16 is built into stepped conduit 13. A second hose 53B, typically of smaller diameter than hose 53A, supplies air to operate the tool in reverse mode. A nozzle of hose 53B is threadedly coupled into a rear socket 105 in air inlet 13, and air flows through a lengthwise passage 107 to one or more radial ports 62 which open onto an outer circumferential groove 61. As in the '270 patent, groove 61 is located between seals 57A, 57B so that, when pressurized air is supplied from hose 53B, repressurization of the front chamber 35 can occur sooner and the tool thereby operates in reverse mode.

Figure 8:
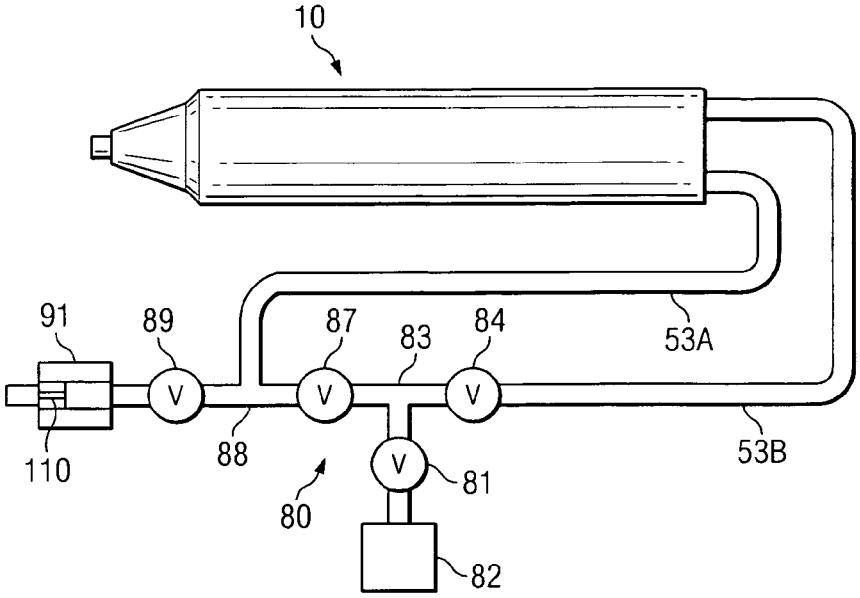
FIG. 8 is a schematic diagram of the tool of FIG. 1 connected to a valve system according to the invention.
Figure 9:
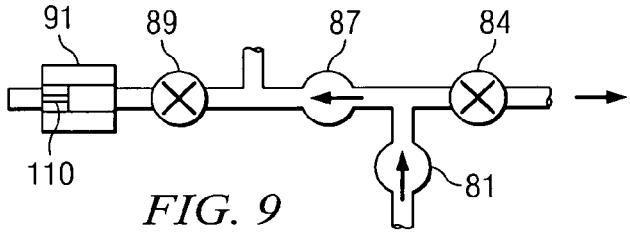
FIG. 9 is a schematic diagram of the valves of FIG. 8 positioned for forward operation.
Figure 10:
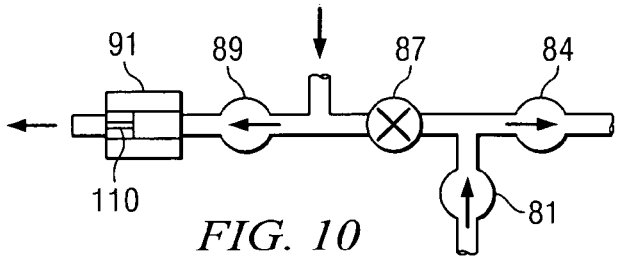
FIG. 10 is a schematic diagram of the valves of FIG. 8 positioned for reverse operation.

FIGS. 8–10 illustrate the difference between the method of the invention and the method of operation used in the '270 patent. The control mechanism is similar. A valve assembly 80 includes a main shutoff valve 81 which cuts off all air from the air compressor 82. When valve 81 is open, compressed air can flow through a branched fitting 83 to a second valve 84 to hose 53B is connected. A further valve 87 regulates air flow through the other branch of fitting 83. When valve 87 is open, compressed air enters a further branched passage or fitting 88 to which hose 53A is connected and thereby enters hose 53A. A fourth valve 89 provided on the other branch of passage 88 isolates passage 88 from a muffler or vent 91. It will be noted that the connections of the forward and reverse air hoses are reversed compared to the arrangement described in the '270 patent. Inside vent 91, a nozzle 110 has an orifice which has only a fraction of the diameter of hose 53A.

Tool 10 of the invention in forward and reverse mode as follows. As shown in FIG. 9, to run tool 10 in forward mode, compressor 82 is turned on with valves 81, 87 open and valves 84, 89 closed. Compressed air flows through hose 53A and enters recess 33, causing the striker 12 to reciprocate and impact the inner wall of the nose 22 of tool 10. Hose 53B remains sealed because valve 84 is closed. Radial passage 62 thus has no effect on the tool's operation.

When switching to reverse mode (FIG. 10), valves 81, 84 and 89 are opened and valve 87 is closed. Compressed air flows through hose 53B, through passage 107 and radial passage 62 in order to change the stroke of the striker 12 as described above. As shown in '270 patent FIG. 10, when the tool of that patent is in reverse mode, hose 53A is sealed by valve 84 (note this discussion refers to 53A of the '270 patent, not 53A of the present application, which is at a different position.) This caused air trapped in recess 33 during the rearward stroke of the striker to act as air spring once radial port 42 passes over the front edge of stepped air inlet 13, propelling the striker forward once the front pressure chamber exhausts due to port 42 passing over the rear edge of stepped air inlet 13.

According to the invention, recess 33 forming the rear pressure chamber is partially open, i.e., is allowed to "leak" to the atmosphere during reverse mode operation when it would otherwise be sealed during the rearward stroke of striker 12. This is accomplished by any suitable means, in this instance by a nozzle 110 installed in vent 91. The diameter of the orifice of nozzle 110 determines the rate of loss of compressed air from recess 33. The ideal orifice size will vary for a given tool size and operating conditions. If the orifice is too large, the reverse stroke will lose power and eventually stall. If it is too small, double-hitting of striker 12 against both the front and rear anvil will occur. Fine adjustment of the size of the orifice, as by using one of a variety of nozzles 110 with different orifice sizes, permits adjustment of the reverse stroke to its maximum length obtainable without double-hitting. For example, where the air flow passage including hose 53A has an inner diameter of 0.5 inch, an orifice diameter of half that size (0.25") has been used successfully. This permits tool 10 to be used more effectively in reverse and permit use in a wider variety of applications, such as vertical pile driving wherein it is necessary to reverse the tool out of a hole in a vertical position.

It will be understood that the foregoing description is of preferred exemplary embodiments of the invention, and that the invention is not limited to the specific forms shown. Modifications may be made in without departing from the scope of the invention as expressed in the appended claims.

What is claimed is:

1. A method of operating a reversible pneumatic ground piercing tool of the type including an elongated tool body having a rear opening and a front nose including an anvil, a striker disposed for reciprocation within an internal chamber of the housing to impart impacts to a rear impact surface of the anvil for driving the tool forwardly through the ground, the striker having a rear bearing in sealed, sliding engagement with an inner wall of the tool body, an air distributing mechanism for effecting reciprocation of the striker, including a rearwardly-opening recess in the striker having a radial air flow port extending through a wall of the recess, a stepped air inlet slidably disposed in the recess in sealed engagement with the recess wall, the stepped air inlet having a front external edge, a rear external edge, a first air flow passage extending through the air inlet from rear to front in a lengthwise direction, and a first air hose connected to the first air flow passage for supplying compressed air to the recess to push the striker forwardly until the radial port in the recess wall passes the front edge of the stepped air inlet, at which time compressed air enters a front pressure chamber ahead of the rear seal bearing of the striker thereby beginning a rearward stroke of the striker, travel of the striker continuing rearwardly until the radial port in the recess wall passes over the rear edge of the stepped air inlet, thereby depressurizing the front pressure chamber, a tail assembly mounted in a rear end opening of the housing that secures the striker and air distributing mechanism in the housing and which receives rearward impacts from the striker when the tool is operating in reverse, and a reversing mechanism including a second air flow passage extending from the rear of the stepped air inlet to a radial port on an exterior surface of the stepped air inlet between the front and rear external edges thereof, and a second air hose connected to the second air flow passage for supplying compressed air to the radial port in the stepped air inlet to pressurize the front pressure chamber when the radial port in the recess wall moves over the radial port in the stepped air inlet, thereby beginning a rearward striker stroke sooner than if no compressed air is supplied to the radial port of the stepped air inlet, wherein the method comprises the steps of:

operating the tool in forward mode by supplying compressed air to the first air hose; and operating the tool in reverse mode by supplying compressed air to the second air hose while permitting partial venting of the front pressure chamber through the first air hose.

2. The method of claim 1, wherein the second air hose, second flow passage and radial port on the exterior surface of the stepped air inlet remain sealed during forward mode operation by closing a valve disposed between the second air hose and an air compressor that feeds compressed air to the second air hose.

3. The method of claim 2, wherein partial venting is accomplished by opening a valve that permits the interior of the first air hose to communicate with the atmosphere through a vent; and feeding vented air flowing from the front pressure chamber flowing through the first air hose through an orifice having a reduced diameter relative to the inner diameter of the first air hose, thereby limiting the rate at which air can escape through the vent.

4. The method of claim 1, wherein partial venting is accomplished by opening a valve that permits the interior of the first air hose to communicate with the atmosphere through a vent; and feeding vented air flowing from the front pressure chamber through the first air hose through an orifice having a reduced diameter relative the inner diameter of the first air hose, thereby limiting the rate at which air can escape through the vent.

5. An apparatus for operating a reversible pneumatic ground piercing tool of the type including an elongated tool body having a rear opening and a front nose including an anvil, a striker disposed for reciprocation within an internal chamber of the housing to impart impacts to a rear impact surface of the anvil for driving the tool forwardly through the ground, the striker having a rear bearing in sealed, sliding engagement with an inner wall of the tool body, an air distributing mechanism for effecting reciprocation of the striker, including a rearwardly-opening recess in the striker having a radial air flow port extending through a wall of the recess, a stepped air inlet slidably disposed in the recess in sealed engagement with the recess wall, the stepped air inlet having a front external edge, a rear external edge, a first air flow passage extending through the air inlet from rear to front in a lengthwise direction, and a first air hose connected to the first air flow passage for supplying compressed air to the recess to push the striker forwardly until the radial port in the recess wall passes the front edge of the stepped air inlet, at which time compressed air enters a front pressure chamber ahead of the rear seal bearing of the striker thereby beginning a rearward stroke of the striker, travel of the striker continuing rearwardly until the radial port in the recess wall passes over the rear edge of the stepped air inlet, thereby depressurizing the front pressure chamber, a tail assembly mounted in a rear end opening of the housing that secures the striker and air distributing mechanism in the housing and which receives rearward impacts from the striker when the tool is operating in reverse, and a reversing mechanism including a second air flow passage extending from the rear of the stepped air inlet to a radial port on an exterior surface of the stepped air inlet between the front and rear external edges thereof, and a second air hose connected to the second air flow passage for supplying compressed air to the radial port in the stepped air inlet to pressurize the front pressure chamber when the radial port in the recess wall moves over the radial port in the stepped air inlet, thereby beginning a rearward striker stroke sooner than if no compressed air is supplied to the radial port of the stepped air inlet, which apparatus comprises:

means for operating the tool in forward mode by supplying compressed air to the first air hose; and means for operating the tool in reverse mode by supplying compressed air to the second air hose while permitting partial venting of the front pressure chamber through the first air hose.

* * * * *